US008994280B2

(12) United States Patent
Su et al.

(10) Patent No.: US 8,994,280 B2
(45) Date of Patent: Mar. 31, 2015

(54) DRIVING CIRCUITS AND DRIVING METHODS THEREOF

(71) Applicant: Princeton Technology Corporation, New Taipei (TW)

(72) Inventors: Ching-Piao Su, New Taipei (TW); Chiung-Hung Chen, New Taipei (TW); Chien-Te Hsu, New Taipei (TW)

(73) Assignee: Princeton Technology Corporation, New Taipei (TW)

( * ) Notice: Subject to any disclaimer, the term of this patent is extended or adjusted under 35 U.S.C. 154(b) by 0 days.

(21) Appl. No.: 13/942,053

(22) Filed: Jul. 15, 2013

(65) Prior Publication Data

US 2014/0184105 A1 Jul. 3, 2014

(30) Foreign Application Priority Data

Dec. 27, 2012 (TW) ..... 101150402 A

(51) Int. Cl.
*H05B 37/02* (2006.01)
*H05B 33/08* (2006.01)

(52) U.S. Cl.
CPC ..... *H05B 33/0827* (2013.01); *H05B 33/0857* (2013.01)
USPC ..... 315/194; 315/360; 315/291; 327/172; 327/175; 327/114

(58) Field of Classification Search
USPC ..... 315/250, 307, 312, 194, 360, 291; 332/109; 345/204; 327/172, 175, 114; 701/1
See application file for complete search history.

(56) References Cited

U.S. PATENT DOCUMENTS

| | | | | |
|---|---|---|---|---|
| 6,633,273 | B2 * | 10/2003 | Ikeda et al. | 345/99 |
| 7,202,607 | B2 * | 4/2007 | Kazar et al. | 315/185 S |
| 7,471,276 | B2 * | 12/2008 | Tomohara | 345/98 |
| 7,843,148 | B2 * | 11/2010 | Gater et al. | 315/291 |
| 8,169,150 | B2 * | 5/2012 | Peker et al. | 315/246 |
| 8,188,679 | B2 * | 5/2012 | Hoogzaad | 315/294 |
| 8,476,843 | B2 * | 7/2013 | Yu et al. | 315/294 |
| 8,552,971 | B2 * | 10/2013 | Ishikawa et al. | 345/102 |
| 2001/0052827 | A1 * | 12/2001 | Sugita et al. | 332/109 |
| 2007/0273678 | A1 * | 11/2007 | Okita et al. | 345/204 |
| 2008/0239166 | A1 * | 10/2008 | Isono | 348/731 |
| 2011/0032008 | A1 * | 2/2011 | Zhao et al. | 327/114 |
| 2013/0038591 | A1 * | 2/2013 | Yang | 345/211 |
| 2013/0063042 | A1 * | 3/2013 | Bora et al. | 315/292 |
| 2013/0088172 | A1 * | 4/2013 | Kikuchi et al. | 315/307 |
| 2013/0257827 | A1 * | 10/2013 | Hsieh et al. | 345/204 |
| 2014/0184090 | A1 * | 7/2014 | Su et al. | 315/250 |
| 2014/0184105 | A1 * | 7/2014 | Su et al. | 315/312 |

* cited by examiner

*Primary Examiner* — Thuy Vinh Tran
*Assistant Examiner* — Syed M Kaiser
(74) *Attorney, Agent, or Firm* — Muncy, Geissler, Olds & Lowe, P.C.

(57) ABSTRACT

A driving circuit includes a first PWM driving module and a second PWM driving module. The first PWM driving module generates a first square-wave signal to drive a first illumination unit according to a first data signal of a data stream, wherein the first square-wave signal, having a rising edge located at the beginning of the display cycle, represents an illumination period of the first illumination unit in a display cycle. The second PWM driving module generates a second square-wave signal to drive a second illumination unit according to a second data signal of the data stream, wherein the second square-wave signal, having a falling edge located at the end of the display cycle and having a rising edge being behind the rising edge of the first square-wave signal, represents an illumination period of the second illumination unit in the display cycle.

16 Claims, 9 Drawing Sheets

DRIVING CIRCUITS AND DRIVING METHODS THEREOF

CROSS REFERENCE TO RELATED APPLICATIONS

This Application claims priority of Taiwan Patent Application No. 101150402, filed on Dec. 27, 2012, the entirety of which is incorporated by reference herein.

BACKGROUND OF THE INVENTION

1. Field of the Invention

The invention is related generally to illumination systems, more particularly, to driving circuits for use in illumination systems.

2. Description of the Related Art

FIG. 1A is a schematic diagram of an illumination system. As shown in FIG. 1A, the illumination system 100 includes a driving circuit 110 and an illumination module 120. The driving circuit 110 includes n channels to drive the illumination units ED1~EDn of the illumination module 120, and each of the illumination units ED1~EDn is coupled to the power line Vp.

FIG. 1B is a diagram depicting the graph of the current on the power line versus time. As shown in FIG. 1B, the waveform Cv1 represents the current of the first channel, the waveform Cv2 represents the current of the second channel, the waveform Cv3 represents the current of the third channel, and the waveform Cvn represents the current of the n-th channel. The waveform Cvs represents the total current summing up all the current waveforms from the waveform Cv1 to the waveform Cvn, which is equivalent to the current of the power line Vp.

Note that since the n channels are simultaneously turned on at the beginning of each display cycle DP, the current of the power line Vp instantly surges from zero to a value being n times the current value of a single channel. This causes the noise to be over-concentrated at the beginning of the display cycle DP. Therefore, a driving circuit and a driving method are needed which can evenly distribute the current of the power line Vp through the display cycle DP.

BRIEF SUMMARY OF THE INVENTION

To solve the above problems, the invention provides a driving circuit, comprising: a first PWM driving module, generating a first square-wave signal to drive a first illumination unit according to a first data signal of a data stream, wherein the first square-wave signal represents an illumination period of the first illumination unit in a display cycle, and a rising edge of the first square-wave signal is located at the beginning of the display cycle; and a second PWM driving module, generating a second square-wave signal to drive a second illumination unit according to a second data signal of the data stream, wherein the second square-wave signal represents an illumination period of the second illumination unit in the display cycle, in which a falling edge of the second square-wave signal is located at the end of the display cycle, and a rising edge of the second square-wave signal is behind the rising edge of the first square-wave signal.

The invention further provides a driving method, adapted in driving a first illumination unit and a second illumination unit, comprising: generating a first square-wave signal according to a first data signal of a data stream, wherein the first square-wave signal represents an illumination period of the first illumination unit in a display cycle, and a rising edge of the first square-wave signal is located at the beginning of the display cycle; driving the first illumination unit according to the first square-wave signal; generating a second square-wave signal according to the second data signal of the data stream, wherein the second square-wave signal represents an illumination period of the second illumination unit in the display cycle, in which a falling edge of the second square-wave signal is located at the end of the display cycle, and a rising edge of the second square-wave signal is behind the rising edge of the first square-wave signal; and driving the second illumination unit according to the second square-wave signal.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1A:
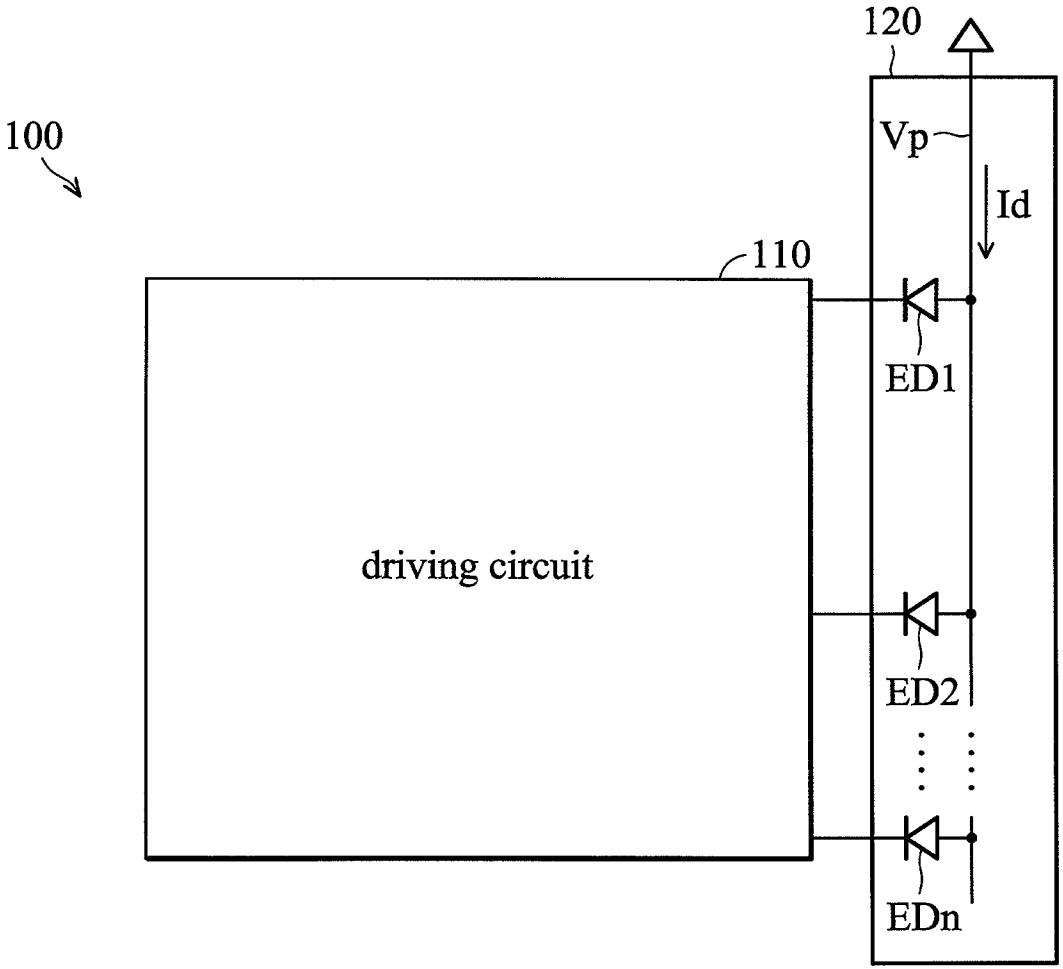
FIG. 1A ( PRIOR ART )
FIG. 1A is a schematic diagram of an illumination system.
Figure 1B:
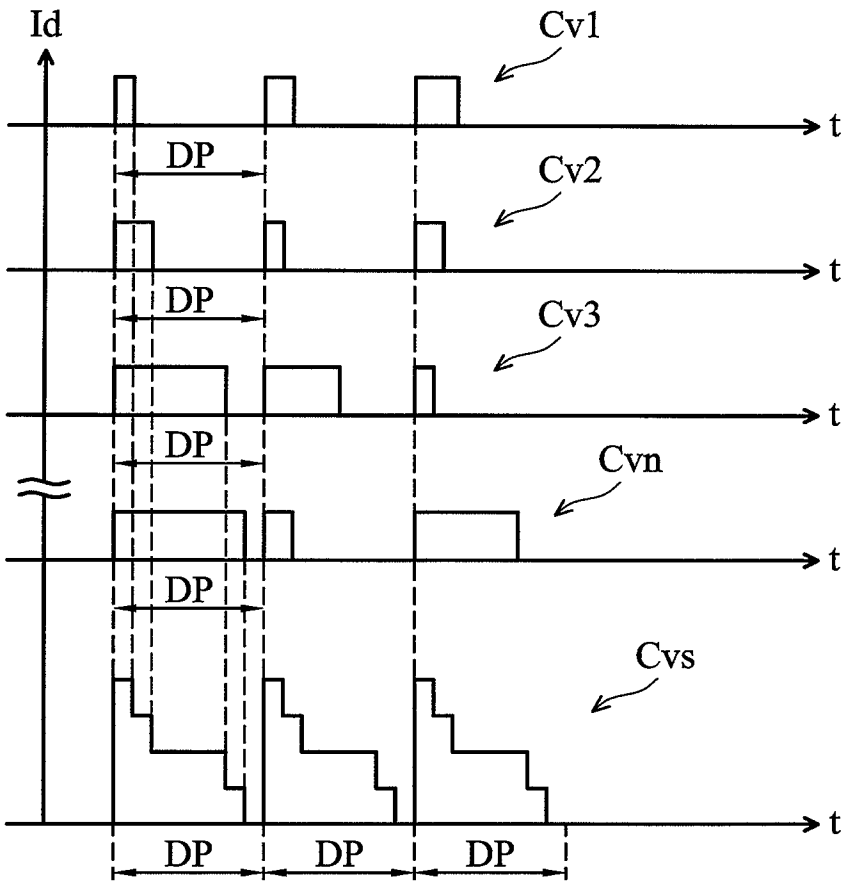
FIG. 1B ( PRIOR ART )
FIG. 1B is a diagram depicting the graph of the current on the power line versus time.
Figure 2:
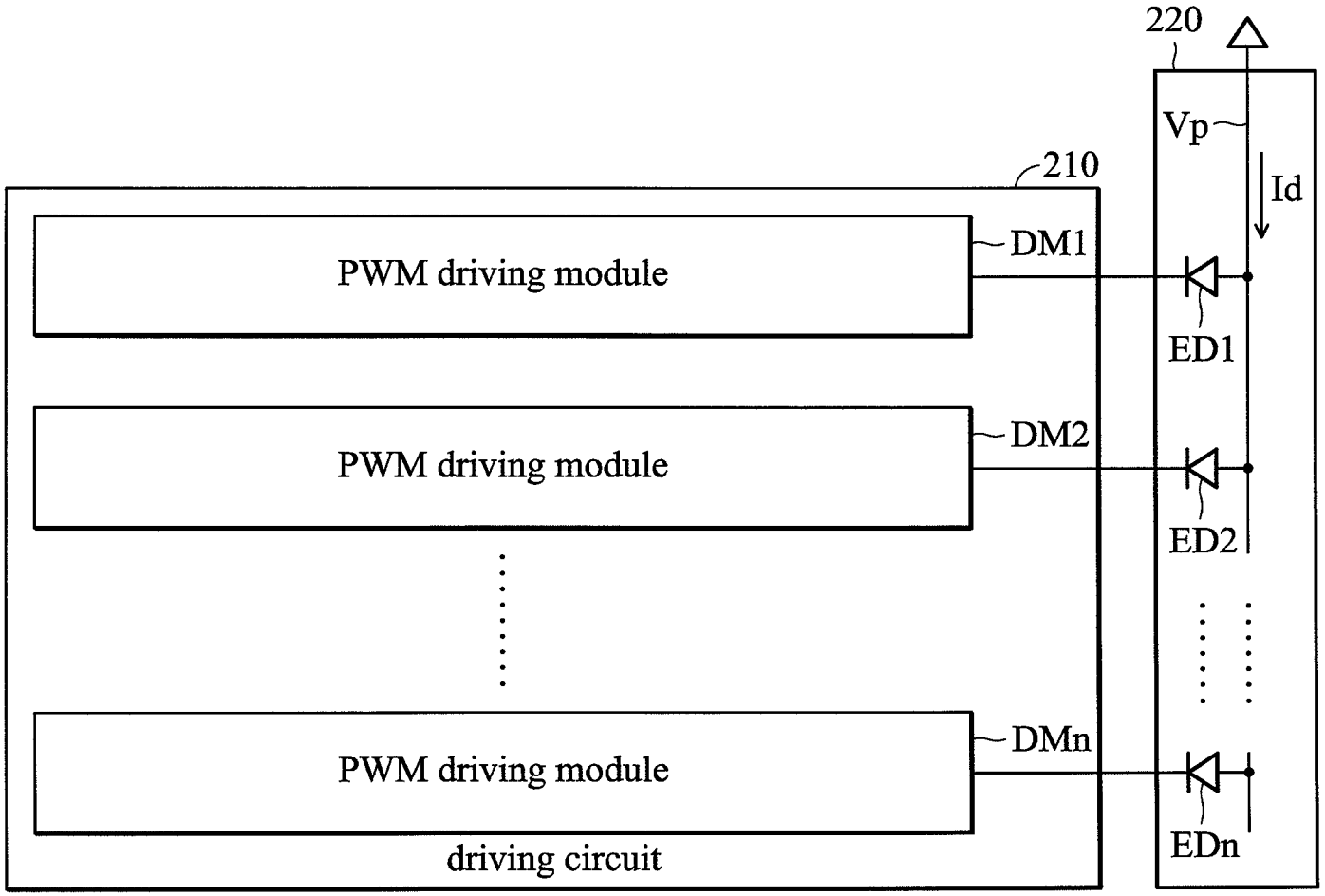
FIG. 2 is a schematic of the driving circuit according to an embodiment of the invention.

FIG. 2 is a schematic of the driving circuit according to an embodiment of the invention. As shown in FIG. 2, the driving circuit 210 includes a plurality of PWM driving modules DM1~DMn which respectively drive a plurality of the illumination units ED1~EDn of the illumination module 220. The illumination units ED1~EDn are coupled with each other in parallel, and each of the illumination units ED1~EDn has a first terminal coupled to a power line Vp and a second terminal coupled to a respective one of the PWM driving modules DM1~DMn. According to another embodiment of the invention, the plurality of the illumination units EDF~EDn of the illumination module 220 can be respectively coupled to a corresponding PWM driving module DM1~DMn by the first terminal and coupled to the ground terminal by the second terminal.

Figure 3:
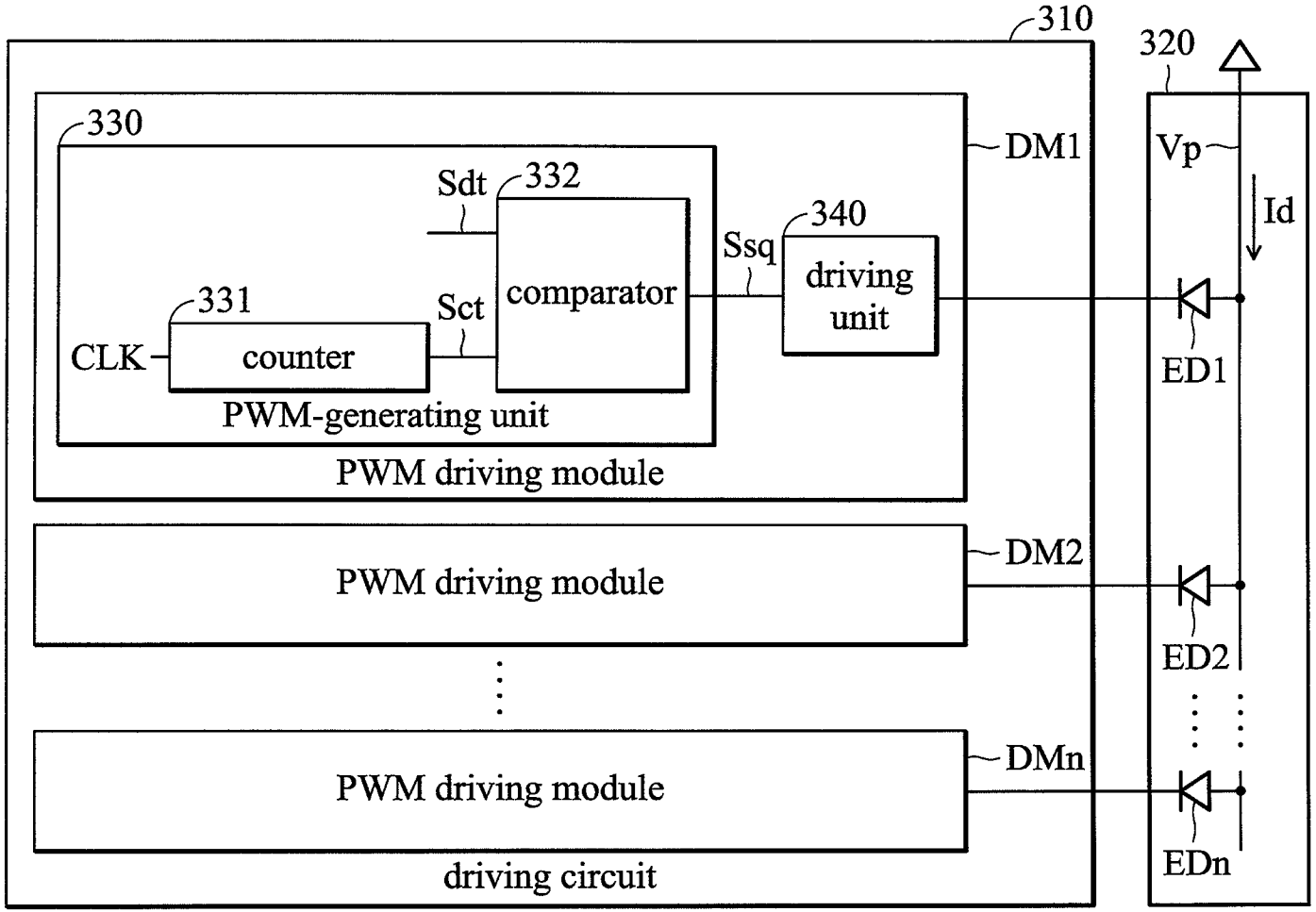
FIG. 3 is a schematic of the driving module according to an embodiment of the invention.

FIG. 3 is a schematic of the driving module according to an embodiment of the invention. A PWM-generating unit 330 determines the illumination period of the illumination units ED1~EDn of the illumination module 320 in a display cycle according to the data signal Sdt. The illumination units ED1~EDn are coupled with each other in parallel which could be light-emitting diodes (LEDs). More specifically, as shown in FIG. 3, each PWM driving module DM1~DMn at least includes a PWM-generating unit 330 and a driving unit 340. The PWM-generating unit 330 outputs a square-wave signal Ssq according to the data signal Sdt. The driving unit 340 is coupled to the PWM-generating unit 330 for driving the illumination unit ED1 according to the square-wave signal Ssq. The data signal Sdt includes the duty cycle (the ratio of the illumination period to the display cycle) of the display cycle.

The PWM-generating unit 330 at least includes a counter 331 and a comparator 332. The counter 331 counts a clock signal CLK to output a counting signal Set. According to an embodiment of the invention, the counter 331 in a portion of the PWM driving modules can be an up counter or a down counter. For example, when the counter 331 is an up counter and receives the first pulse of the clock signal CLK, the value of the counting signal Sct is 1. Similarly, when the counter 331 receives the second pulse of the clock signal CLK, the value of the counting signal Set is 2. Likewise, when the counter 331 receives the 255-th pulse of the clock signal CLK, the value of the counting signal Sct is 255. When the counter 331 further receives the 256-th pulse of the clock signal CLK, the counter 331 is reset and the value of the counting signal Set is 0.

When the counter 331 is a down counter and receives the first pulse of the clock signal CLK, the value of the counting signal Set is 255. Similarly, when the counter 331 receives the second pulse of the clock signal CLK, the value of the counting signal Set is 254. Likewise, when the counter 331 receives the 255-th pulse of the clock signal CLK, the value of the counting signal Sct is 1. When the counter 331 further receives the 256-th pulse of the clock signal CLK, the counter 331 is reset and the value of the counting signal Sct is 0.

The comparator 332 generates the square-wave signal Ssq according to the counting signal Set and the data signal Sdt. According to an embodiment of the invention, the comparator 332 includes a positive terminal coupled to the counter 331 and a negative terminal coupled to a PWM register (not shown in FIG. 3), so that the square-wave signal Ssq is at a high voltage level when the counting signal Sct is higher than the data signal Sdt, while the square-wave signal Ssq is at a low voltage level when the counting signal Sct is lower than the data signal Sdt.

The instance that the data signal Sdt is 004 and the display cycle includes 255 time units UT1~UT255 is to be taken an example for illustration. During the time units UT1~UT4, the counting signal Sct of the up counter is 001~004 (not larger than 004), and the square-wave signal Ssq is thus at a low voltage level. During the time units UT5~UT255, the counting signal Sct of the up counter is 005~255 (larger than 004), and the square-wave signal Ssq is thus at a high voltage level. On the contrary, during the time units UT1~UT251, the counting signal Sct of the down counter is 255~005 (larger than 004), and the square-wave signal Ssq is thus at a high voltage level. During the time units UT252~UT255, the counting signal Sct of the down counter is 004~001 (not larger than 004), and the square-wave signal Ssq is thus at a low voltage level.

Therefore, when the counter 331 is an up counter, almost all of the illumination units are turned on within the time unit UT1 in each display cycle, which induces a maximum current on the power line Vp. However, when all of the illumination units ED1~EDn are to be simultaneously turned on within the time unit UT1 in each display cycle, the power line Vp must provide the maximum current by driving the current to ascend instantaneously from zero to the maximum current, thereby resulting in noise and inflicting adverse effect on the circuitry. To tackle this problem, according to an embodiment of the invention, the PWM driving modules DM1~DMn are divided into a plurality of groups which include at least a first group and a second group. The square-wave signal driving the first group and the square-wave signal driving the second group are opposite in phase, and the ON time and the OFF time of the first group and the second group of the illumination units are thus complementary. The maximum current to be withstood by the power line Vp is thus averagely distributed through every time unit of a display cycle.

According to an embodiment of the invention, the counter of the first group is an up counter, and the counter of the second group is a down counter. A portion of the illumination units ED1~EDn are thus not turned on within the time unit UT1, and the burden of the power line Vp caused by turning on the illumination units ED1~ENn within the same time unit is therefore alleviated.

For example, the illumination module 220 includes illumination units ED1~ED16 (n=16), and the driving circuit 110 includes 16 channels (that is, the driving modules DM1~DM16). The driving module DM1~DM16 can be divided into two groups, where the first group includes the driving modules DM1~DM8, and the second group includes the driving modules DM9~DM16. In addition, the counters of the driving modules DM1~DM8 are up counters, and the counters of the driving modules DM9~DM16 are down counters. The grouping of the driving modules is taken for illustrative purpose, and not to be taken in a limiting sense. That is, for example, DMi (where i is an odd number) can also be deemed as the first group, while DMj (where j is an even number) can be deemed as the second group.

Figure 4:
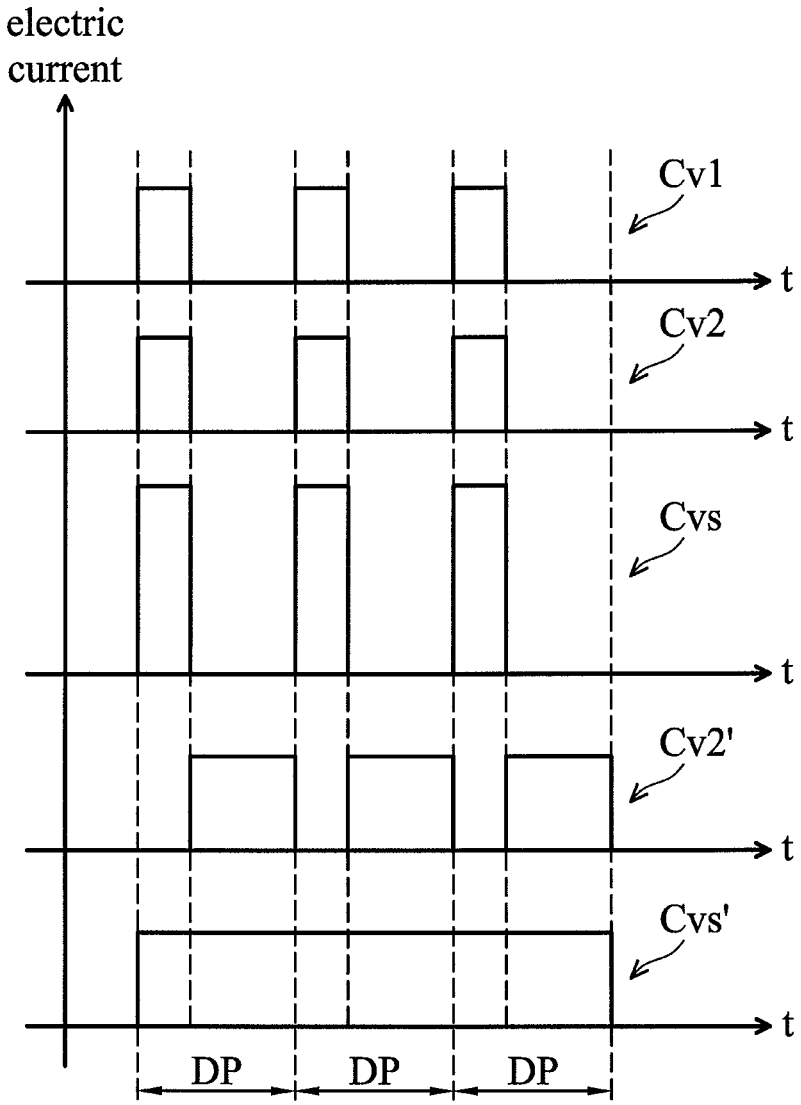
FIG. 4 is a diagram depicting the graph of the current on the power line versus time according to an embodiment of the invention.

FIG. 4 is a diagram of the current on the power line versus time according to an embodiment of the invention. According to the driving method of the PWM, the current waveforms shown in FIG. 4 are in-phase or out-phase with the PWM square-wave signal. According to the embodiment of the invention in FIG. 3, the current waveforms are out-phase with the square-wave signal Ssq. According to another embodiment of the invention, a plurality of the illumination units ED1~EDn can be coupled to the respective PWM driving modules DM1~DMn by the first terminal and coupled to the ground terminal by the second terminal, in which the current waveforms are in-phase with the square-wave signal Ssq.

As shown in FIG. 4, the waveform Cv1 shows the current on the power line Vp induced by the first group, the waveform Cv2 shows the current on the power line Vp induced by the second group, and the waveform Cvs shows the current on the power line Vp induced by the first and second groups, in which the counters of the first and second groups are all up counters. The waveform Cv2' shows the current on the power line Vp induced by the second group, in which the counters of the second group are all down counters, and waveform Cvs' is the sum of the waveform Cv1 and the waveform Cv2'. Note that by grouping the illumination units into a first group and a second group and staggering the illumination periods of the first group and the illumination periods of the second group in a display cycle DP, the current loaded on the power line Vp is distributed through the entire display cycle DP instead of being concentrated on a portion of the display cycle DP, and the distribution of the current is much more even (comparing the waveform Cvs' with the waveform Cvs). In an embodiment of the invention, the rising edge of the waveform Cv1 is located at the beginning of the display cycle DP, and the falling edge of the waveform Cv2' is located at the end of the display cycle DP. Moreover, the rising edge of the waveform Cv2' and the falling edge of waveform Cv1 are temporally concurrent.

Figure 5:
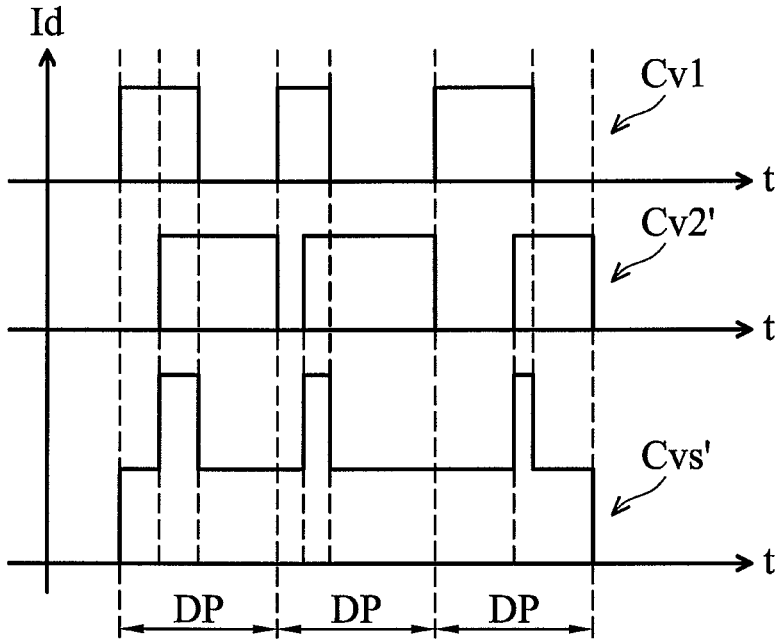
FIG. 5 is a diagram depicting the graph of the current on the power line versus time according to another embodiment of the invention.

FIG. 5 is a diagram depicting the graph of the current on the power line versus time according to another embodiment of the invention. According to the driving method of PWM, the current waveforms shown in FIG. 5 can be in-phase or out-phase with the square-wave signal of PWM. According to the embodiment of the invention in FIG. 3, the current waveforms are out-phase with the square-wave signal Ssq. In this embodiment, a plurality of the illumination units ED1~EDn can be coupled to the respective PWM driving modules DM1~DMn by the first terminal and coupled to the ground terminal by the second terminal, in which the current waveforms are the same as the square-wave signal Ssq.

As shown in FIG. 5, the waveform Cv1 shows the current on the power line Vp induced by the first group, the waveform Cv2' shows the current on the power line Vp induced by the second group, and the waveform Cvs' shows the total current on the power line Vp induced by the first and second groups, in which the counters of the first and second groups are all up counters. In this embodiment of the invention, the rising edge of the waveform Cv1 is located at the beginning of the display cycle DP, the falling edge of the waveform Cv2' is located at the end of the display cycle DP, and the rising edge of the waveform Cv2' is behind the rising edge of the waveform Cv1, resulting in a waveform Cvs'. In addition, the width (duty cycle) of the waveform Cv1 and the width of the waveform Cv2' may be different at different display cycles.

Figure 6:
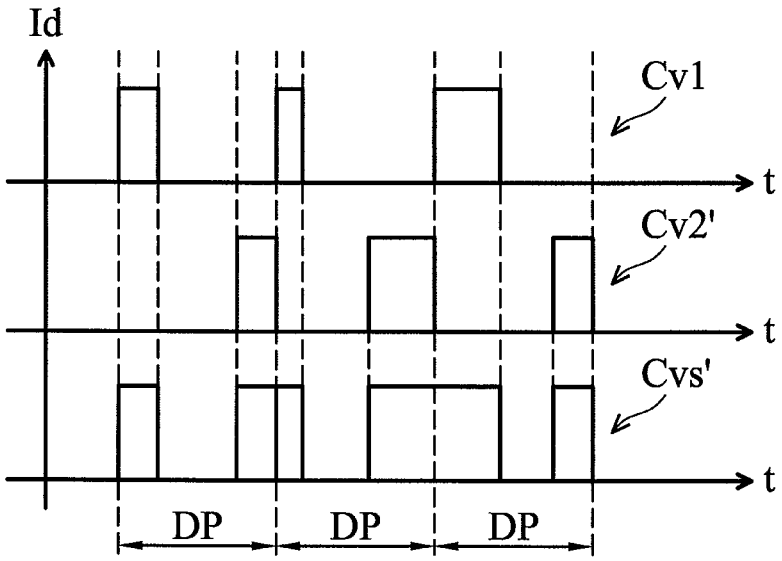
FIG. 6 is a diagram depicting the graph of the current on the power line versus time according to yet another embodiment of the invention.

FIG. 6 is a diagram depicting the graph of the current on the power line versus time according to yet another embodiment of the invention. According to the driving method of PWM, the current waveforms shown in FIG. 6 can be in-phase or out-phase with the square-wave signal of PWM. According to the embodiment of the invention in FIG. 3, the current waveforms are out-phase with the square-wave signal Ssq. In this embodiment of the invention, a plurality of the illumination units ED1~EDn can be coupled to the respective PWM driving modules DM1~DMn by the first terminal and coupled to the ground terminal by the second terminal, in which the current waveforms are the same as the square-wave signal Ssq.

As shown in FIG. 6, the waveform Cv1 shows the current on the power line Vp induced by the first group, the waveform Cv2' shows the current on the power line Vp induced by the second group, and the waveform Cvs' shows the total current on the power line Vp induced by the first and second groups, in which the rising edge of the waveform Cv2' is behind the falling edge of the waveform Cv1. In addition, the width (duty cycle) of the waveform Cv1 and the width of the waveform Cv2' may be different at different display cycles.

Figure 7:
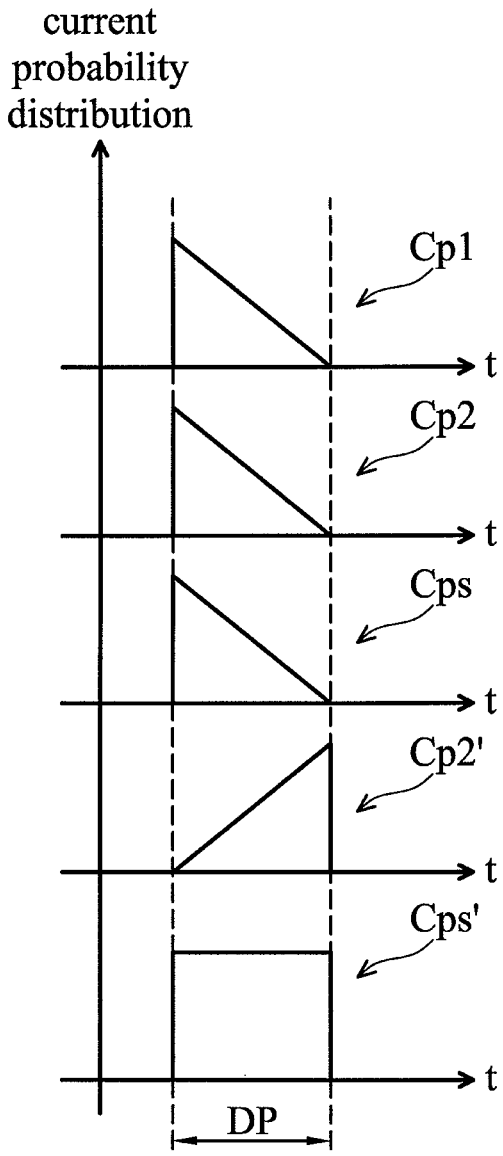
FIG. 7 is a diagram depicting the chart of the current probability distribution.

FIG. 7 is a diagram depicting the chart of the current probability distribution. As shown in FIG. 7, the waveform Cp1 shows the current probability distribution on the power line Vp caused by the first group, and the waveform Cp2 shows the current probability distribution on the power line Vp caused by the second group, where the counters of the first and second groups are all up counters. Since the respective illumination units are driven at the beginning of the display cycle DP as indicated by the waveform Cp1 and the waveform Cp2, the highest probability of current generation is emerged at the beginning of the display cycle DP. However, there is usually no current induced at the end of the display cycle DP, and thus the probability of current generation at the end of the display cycle DP is almost zero. The waveform Cps is the total current probability distribution on the power line Vp caused by the first and second groups. The current probability distribution on the power line Vp caused by the first group and the current probability distribution on the power line Vp caused by the second groups, which are in-phase with each other, are respectively shown in the waveform Cp1 and the waveform Cp2, wherein the waveform Cps, representing the total current probability distribution on the power line Vp caused by the first and second groups, is also the same as the current probability distribution shown in the waveform Cp1 and the current probability distribution shown in the waveform Cp2.

The waveform Cp2' is the current probability distribution on the power line Vp caused by the second group, where the counters of the second group are all down counters. The waveform Cps' is the total current probability distribution on the power line Vp caused by the first and second groups. Note that by grouping the illumination units into a first group and a second group and changing the beginning point and the end point of the current outputted by the driving unit with the aid of employing the up counters and the down counters, the probability of current generation within each time unit of the display cycle DP is more even, thereby reducing the instant peak load on the power line Vp.

Figure 8:
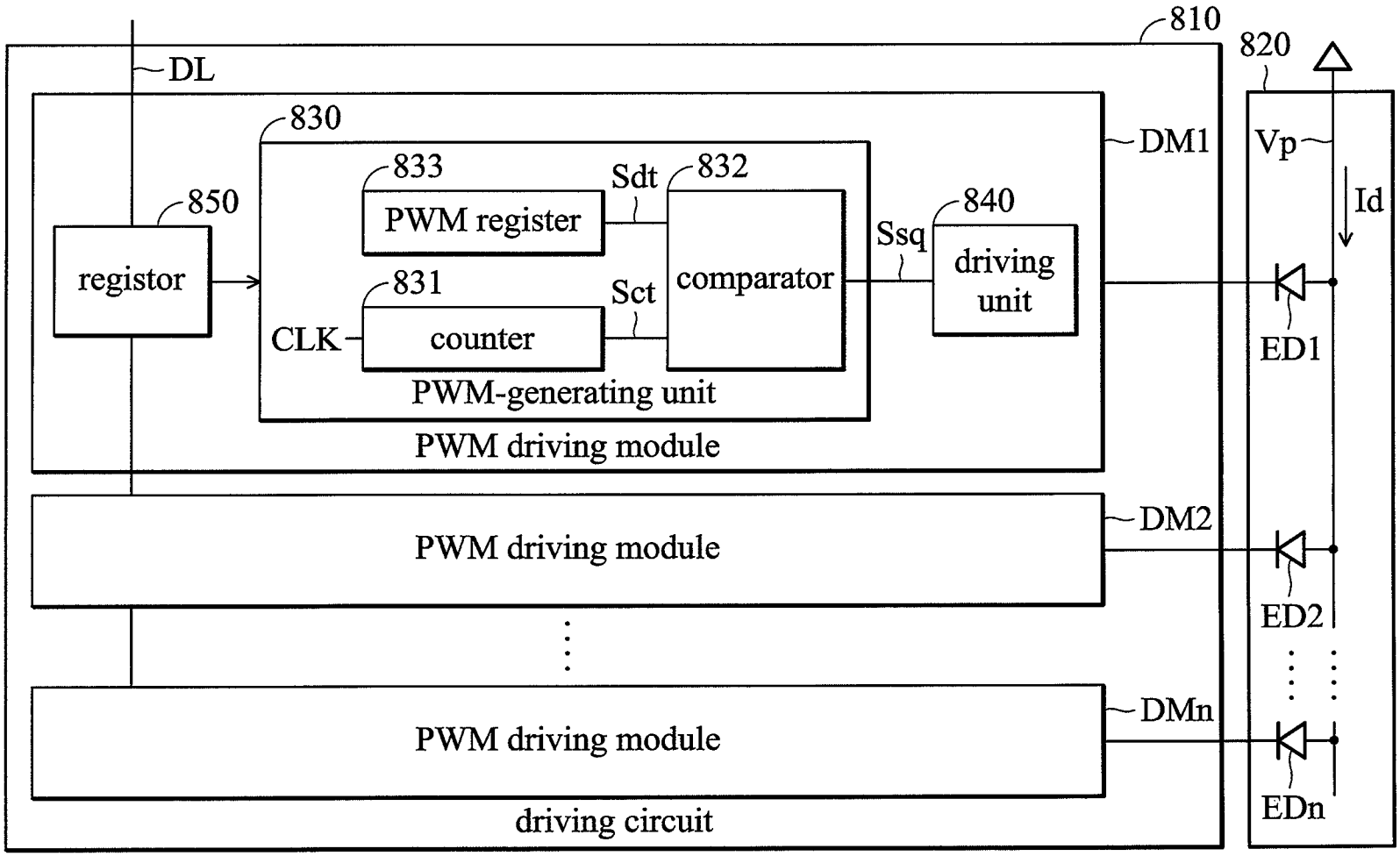
FIG. 8 is a schematic of the driving circuit according to an embodiment of the invention.

FIG. 8 is a schematic of the driving circuit according to an embodiment of the invention. As shown in FIG. 8, the driving circuit 810 is similar to the driving circuit 310, and the difference is that each of the PWM driving modules DM1~DMn includes a register unit 850 which buffers the data signal Sdt on the data line DL and outputs the data signal Sdt to a PWM-generating unit 830. Each PWM-generating unit 830 includes a PWM register 833 which stores the data signal Sdt from the register unit 850 and outputs the data signal Sdt to the comparator 832.

In this embodiment of the invention, the comparator 832 includes a positive terminal coupled to the counter 831 and a negative terminal coupled to the PWM register 833, so that the square-wave signal Ssq is at a high voltage level when the counting signal Set is higher than the data signal Sdt. In another embodiment of the invention, the comparator includes a positive terminal coupled to the PWM register 833 and a negative terminal coupled to the counter 831, so that the square-wave signal Ssq is at a high voltage level when the data signal Sdt is higher than the counting signal Sct.

Figure 9:
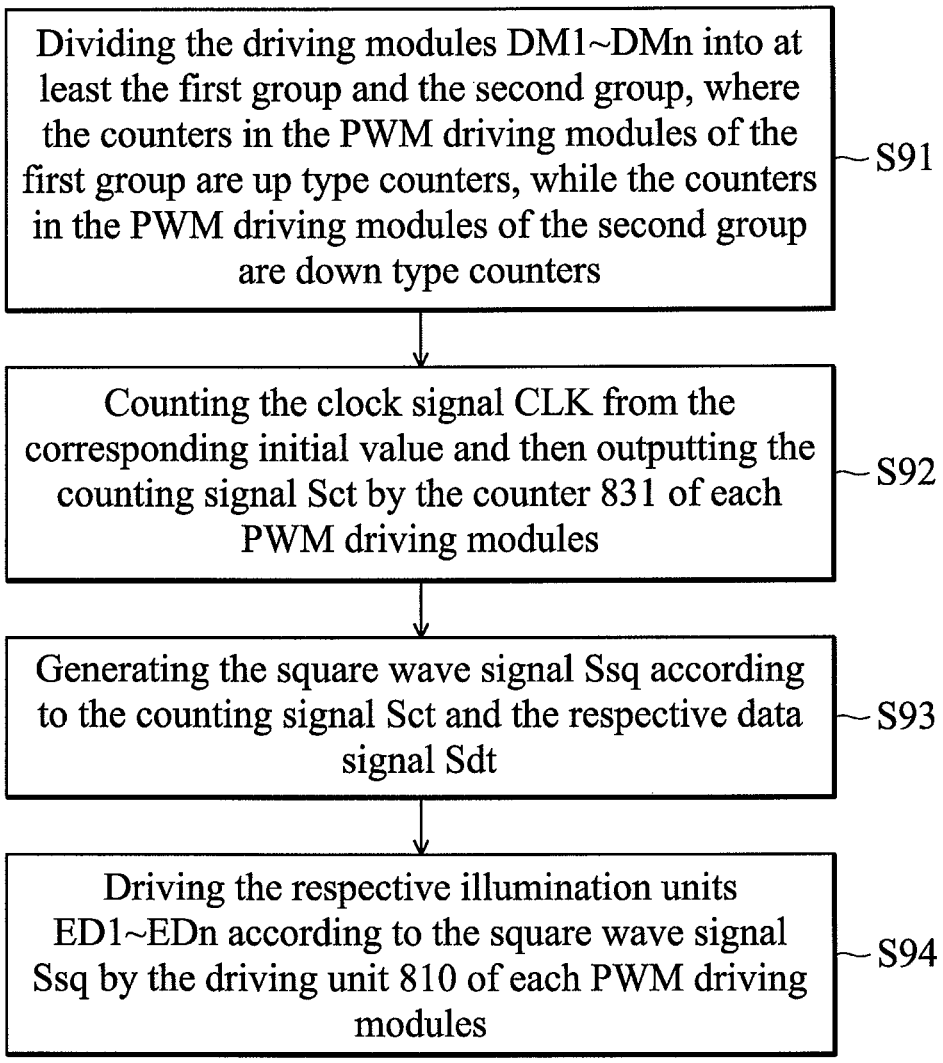
FIG. 9 is a flow chart of the method of driving illumination unit according to an embodiment of the invention.

FIG. 9 is a flow chart of the method of driving illumination unit according to an embodiment of the invention. As shown in FIG. 9, the driving method includes the following steps:

In step S91, the PWM driving modules DM1~DMn are at least divided into a first group and a second group, in which the counters in the PWM driving modules of the first group are up counters, and the counters in the PWM driving modules of the second group are down counters. In Step S92, the counter 831 of each PWM driving module starts counting the clock signal CLK from an initial value and then outputs the counting signal Sct. In step S93, the comparator 832 of each PWM driving module generates the square-wave signal Ssq according to the counting signal Sct and a respective data signal Sdt. In step S94, the driving unit 810 of each PWM driving module drives the respective illumination units ED1~EDn according to the square-wave signal Ssq.

In summary, the counter 331 of the first group in the invention counts in a different way with the second group, and the possibility of all illumination units ED~EDn being turned on within the first time unit (e.g. UT1) or within the last time unit (e.g. UT255) of the display cycle DP is therefore reduced. Also, the instant peak load on the power line Vp is reduced as well.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A driving circuit, comprising:

a first PWM driving module, generating a first square-wave signal to drive a first illumination unit according to a first data signal of a data stream, wherein the first square-wave signal represents an illumination period of the first illumination unit in a display cycle, and a rising edge of the first square-wave signal is located at the beginning of the display cycle, wherein a first register unit receives the first data signal and outputs the first data signal to the first PWM driving module; and a second PWM driving module, generating a second square-wave signal to drive a second illumination unit according to a second data signal of the data stream, wherein the second square-wave signal represents an illumination period of the second illumination unit in the display cycle, and a falling edge of the second square-wave signal is located at the end of the display cycle, and wherein a rising edge of the second square-wave signal is behind the rising edge of the first square-wave signal, wherein a second register unit receives the second data signal and outputs the second data signal to the second PWM driving module.

2. The driving circuit of claim 1, wherein the rising edge of the second square-wave signal is behind a falling edge of the first square-wave signal.

3. The driving circuit of claim 1, wherein the first PWM driving module comprises:

a first PWM-generating unit, outputting the first square-wave signal according to the first data signal, and a first driving unit, coupled to the first PWM-generating unit, for driving the first illumination unit according to the first square-wave signal; and wherein the second PWM driving module comprises:

a second PWM-generating unit, outputting the second square-wave signal according to the second data signal, and a second driving unit, coupled to the second PWM-generating unit, for driving the second illumination unit according to the second square-wave signal.

4. The driving circuit of claim 3, wherein the first PWM-generating unit comprises:

a first counter, counting a clock signal to output a first counting signal; and a first comparator, generating the first square-wave signal according to the first counting signal and the first data signal; and wherein the second PWM-generating unit comprises:

a second counter, counting the clock signal to output a second counting signal, and a second comparator, generating the second square-wave signal according to the second counting signal and the second data signal.

5. The driving circuit of claim 4, wherein the first counter is an up counter and the second counter is a down counter.

6. The driving circuit of claim 4, wherein the first illumination unit is coupled to the second illumination unit in parallel, a first terminal of the first illumination unit and a first terminal of the second illumination unit are coupled to a power line, a second terminal of the first illumination unit is coupled to the first PWM driving module, and a second terminal of the second illumination unit is coupled to the second PWM driving module.

7. The driving circuit of claim 1, wherein the first PWM-generating unit further comprises:

a first PWM register, coupled between the first register unit and the first comparator, for storing the first data signal; and wherein the second PWM-generating unit further comprises:

a second PWM register, coupled between the second register unit and the second comparator, for storing the second data signal.

8. The driving circuit of claim 7, wherein the first comparator comprises a positive terminal coupled to the first counter and a negative terminal coupled to the first PWM register, such that the first square-wave signal is at a high voltage level when the first counting signal is higher than the first data signal, and wherein the second comparator comprises a first terminal coupled to the second counter and a negative terminal coupled to the second PWM register, such that the second square-wave signal is at a high voltage level when the second counting signal is higher than the second data signal.

9. The driving circuit of claim 7, wherein the first comparator comprises a positive terminal coupled to the first PWM register and a negative terminal coupled to the first counter, such that the first square-wave signal is at a high voltage level when the first data signal is higher than the first counting signal, and the second comparator comprises a positive terminal coupled to the second PWM register and a negative terminal coupled to the second counter, such that the second square-wave signal is at a high voltage level when the second data signal is higher than the second counting signal.

10. The driving circuit of claim 1, wherein the first illumination unit and the second illumination unit are light-emitting diodes (LEDs).

11. A driving method, adapted in driving a first illumination unit and a second illumination unit, comprising:

generating a first square-wave signal according to a first data signal of a data stream, wherein the first data signal is buffered by a first register unit, wherein the first square-wave signal represents an illumination period of the first illumination unit in a display cycle, and a rising edge of the first square-wave signal is located at the beginning of the display cycle;

driving the first illumination unit according to the first square-wave signal;

generating a second square-wave signal according to the second data signal of the data stream, wherein the second data signal is buffered by a second register unit, wherein the second square-wave signal represents an illumination period of the second illumination unit in the display cycle, and a falling edge of the second square-wave signal is located at the end of the display cycle, and wherein a rising edge of the second square-wave signal is behind the rising edge of the first square-wave signal; and driving the second illumination unit according to the second square-wave signal.

12. The driving method of claim 11, wherein the rising edge of the second square-wave signal is behind a falling edge of the first square-wave signal.

13. The driving method of claim 11, wherein the steps of generating the first square-wave signal and the second square-wave signal comprise:

outputting a first counting signal by counting a clock signal with an up counter;

outputting a second counting signal by counting the clock signal with a down counter;

comparing the first counting signal and the first data signal and in response thereto generating the first square-wave signal; and comparing the second counting signal and the second data signal and in response thereto generating the second square-wave signal.

14. The driving method of claim 13, wherein the first square-wave signal is at a high voltage level when the first counting signal is higher than the first data signal, and the second square-wave signal is at a high voltage level when the second counting signal is higher than the second data signal.

15. The driving method of claim 13, wherein the first square-wave signal is at a high voltage level when the first data signal is higher than the first counting signal, and the second square-wave signal is at a high voltage level when the second data signal is higher than the second counting signal.

16. The driving circuit of claim 11, wherein the first illumination unit and the second illumination unit are light-emitting diodes (LEDs).

* * * * *